US008915359B2

(12) United States Patent
DiLiberto et al.

(10) Patent No.: US 8,915,359 B2
(45) Date of Patent: Dec. 23, 2014

(54) CONTAINER HAVING A TEARABLE PACKET THEREIN

(75) Inventors: David DiLiberto, Rochester, NY (US); Katherine Adele Bukys, Penfield, NY (US); Christopher Roy Pinto, Framingham, MA (US); Mitchell Francis Rovito, Mayfield, NY (US); Thomas E. Van Epps, Rochester, NY (US)

(73) Assignee: David Diliberto, Rochester, NY (US)

( * ) Notice: Subject to any disclaimer, the term of this patent is extended or adjusted under 35 U.S.C. 154(b) by 515 days.

(21) Appl. No.: 13/160,712

(22) Filed: Jun. 15, 2011

(65) Prior Publication Data

US 2011/0308977 A1 Dec. 22, 2011

Related U.S. Application Data

(60) Provisional application No. 61/355,600, filed on Jun. 17, 2010.

(51) Int. Cl.
*B65D 25/08* (2006.01)
*B65D 81/32* (2006.01)

(52) U.S. Cl.
CPC ..... *B65D 81/3272* (2013.01)
USPC ..... 206/222; 383/38

(58) Field of Classification Search
USPC ..... 206/222, 219, 459.1, 459.5; 383/37, 38, 383/120, 200, 207–209, 5, 906
See application file for complete search history.

(56) References Cited

U.S. PATENT DOCUMENTS

| | | | | |
|---|---|---|---|---|
| 2,157,169 | A * | 5/1939 | Foster | 126/263.01 |
| 2,885,104 | A * | 5/1959 | Greenspan | 206/222 |
| 2,916,197 | A | 12/1959 | Detrie et al. | |
| 3,085,681 | A * | 4/1963 | Fazzari | 206/222 |
| 3,156,352 | A | 11/1964 | Kayhurst | |
| 3,343,664 | A * | 9/1967 | Poitras | 206/219 |
| 3,380,646 | A | 4/1968 | Doyen et al. | |
| 3,429,429 | A | 2/1969 | Poitras | |
| 3,608,709 | A | 9/1971 | Pike | |
| 3,743,520 | A | 7/1973 | Croner | |
| 3,744,625 | A | 7/1973 | Chin | |
| 3,755,389 | A | 8/1973 | Blaney | |
| 3,756,389 | A | 9/1973 | Firth | |
| 3,809,224 | A | 5/1974 | Greenwood | |
| 3,983,994 | A | 10/1976 | Wyslotsky | |

(Continued)

FOREIGN PATENT DOCUMENTS

| | | |
|---|---|---|
| EP | 1036742 | 9/2000 |
| WO | WO/2011/115987 | 12/2011 |
| WO | WO/2011/159873 | 12/2011 |

OTHER PUBLICATIONS

PCT/US2013/023056 An Unofficial Copy of an International Search Report and Written Opinion Dated March 22, 2013 for PCT/US2013/023056 Filed January 25, 2013, Corresponds to U.S. Appl. No. 13/749,370; Inventor: David Diliberto et al.

(Continued)

*Primary Examiner* — David Fidei
*Assistant Examiner* — Mollie Llewellyn
(74) *Attorney, Agent, or Firm* — Duane C. Basch; Basch & Nickerson LLP

(57) ABSTRACT

Disclosed is a multi-compartment container including a tearable inner packet, as well as methods for its use and manufacture.

12 Claims, 11 Drawing Sheets

(56) References Cited

U.S. PATENT DOCUMENTS

| | | | | |
|---|---|---|---|---|
| 4,057,047 | A | 11/1977 | Gossett | |
| 4,233,325 | A | 11/1980 | Slangan et al. | |
| 4,235,332 | A * | 11/1980 | Andersen et al. | 206/219 |
| 4,264,007 | A | 4/1981 | Hunt | |
| 4,458,811 | A | 7/1984 | Wilkinson | |
| 4,462,224 | A | 7/1984 | Dunshee et al. | |
| 4,509,642 | A * | 4/1985 | Rowell | 206/219 |
| 4,519,499 | A | 5/1985 | Stone et al. | |
| 4,596,713 | A | 6/1986 | Burdette | |
| 4,602,910 | A | 7/1986 | Larkin | |
| 4,608,043 | A | 8/1986 | Larkin | |
| 4,632,244 | A | 12/1986 | Landau | |
| 4,998,666 | A * | 3/1991 | Ewan | 229/102 |
| 5,114,004 | A | 5/1992 | Isono et al. | |
| 5,246,142 | A | 9/1993 | DiPalma et al. | |
| 5,287,961 | A | 2/1994 | Herran | |
| 5,394,980 | A | 3/1995 | Tsai | |
| 5,423,421 | A | 6/1995 | Inoue et al. | |
| 5,465,707 | A | 11/1995 | Fulcher et al. | |
| 5,492,219 | A | 2/1996 | Stupar | |
| 5,577,369 | A | 11/1996 | Becker et al. | |
| 5,836,445 | A | 11/1998 | Provonchee | |
| 5,853,689 | A | 12/1998 | Klatte | |
| 5,885,635 | A | 3/1999 | Spring et al. | |
| 5,944,709 | A | 8/1999 | Barney et al. | |
| 5,967,308 | A | 10/1999 | Bowen | |
| 6,017,598 | A | 1/2000 | Kreischer et al. | |
| 6,036,004 | A | 3/2000 | Bowen | |
| 6,068,898 | A | 5/2000 | Oyama | |
| 6,086,609 | A | 7/2000 | Buckley | |
| 6,165,161 | A | 12/2000 | York et al. | |
| 6,174,508 | B1 | 1/2001 | Klatte | |
| 6,186,998 | B1 | 2/2001 | Inuzuka et al. | |
| 6,203,535 | B1 | 3/2001 | Barney et al. | |
| 6,289,889 | B1 | 9/2001 | Bell et al. | |
| 6,506,092 | B1 * | 1/2003 | Kuracina et al. | 446/81 |
| 6,578,572 | B2 | 6/2003 | Tischer et al. | |
| 6,743,451 | B2 | 6/2004 | Rasile et al. | |
| 6,758,572 | B2 | 7/2004 | Ladyjensky | |
| 6,833,170 | B1 | 12/2004 | Knoerzer et al. | |
| 6,846,305 | B2 | 1/2005 | Smith et al. | |
| 6,866,145 | B2 | 3/2005 | Richards et al. | |
| 6,935,492 | B1 | 8/2005 | Loeb | |
| 6,968,952 | B2 | 11/2005 | Crevier et al. | |
| 6,996,951 | B2 | 2/2006 | Smith et al. | |
| 7,055,683 | B2 | 6/2006 | Bourque et al. | |
| 7,169,138 | B2 | 1/2007 | Becker et al. | |
| 7,255,506 | B2 | 8/2007 | Gruenbacher et al. | |
| 7,306,095 | B1 | 12/2007 | Bourque et al. | |
| 7,419,300 | B2 | 9/2008 | Pawloski et al. | |
| 7,438,428 | B2 | 10/2008 | Schrimmer et al. | |
| 7,575,384 | B2 | 8/2009 | Bauer et al. | |
| 7,582,340 | B2 | 9/2009 | Hagino | |
| 7,618,406 | B2 | 11/2009 | Roger | |
| 7,628,939 | B2 | 12/2009 | Solsberg | |
| 7,794,485 | B2 | 9/2010 | Caceres et al. | |
| 2002/0066678 | A1 | 6/2002 | Sharon et al. | |
| 2003/0047467 | A1 | 3/2003 | Smith et al. | |
| 2003/0116452 | A1 | 6/2003 | Saric et al. | |
| 2005/0224388 | A1 | 10/2005 | Saric et al. | |
| 2006/0005827 | A1 * | 1/2006 | Consoli et al. | 126/263.06 |
| 2006/0093765 | A1 | 5/2006 | Mueller | |
| 2006/0196784 | A1 * | 9/2006 | Murray | 206/219 |
| 2007/0278114 | A1 | 12/2007 | Kane et al. | |
| 2008/0276645 | A1 | 11/2008 | Murray | |
| 2009/0178945 | A1 * | 7/2009 | Moehlenbrock et al. | 206/484 |
| 2009/0238495 | A1 | 9/2009 | Anderson | |
| 2012/0180777 | A1 * | 7/2012 | Young | 126/263.01 |

OTHER PUBLICATIONS

PCT/US2011/40653—An International Search Report and Written Opinion dated Dec. 2, 2011 for PCT/US2011/40653 filed Jun. 16, 2011; Inventor David DiLiberto.

CN 201180029792.X—An Unofficial Chinese Office Action (With Partial Translation) Dated January 21, 2014 for Chinese Patent Application CN 201180029792.X Filed June 16, 2011, Published February 27, 2013, as CN102947196A; Corresponding to U.S. Appl. No. 13/160,712; Inventor:David Diliberto, et al.

Korea 10-2013-7001176—An Unofficial Korean Office Action (With Partial Translation) Dated Mar. 25, 2014 for Korean Patent Application Filed Jan. 16, 2013, Corresponding to U.S. Appl. No. 13/160,712; Inventor: David Diliberto, et al.

U.S. Appl. No. 13/749,370—Unofficial the File History of Co-Pending US Patent Application Filed Jan. 24, 2013.

* cited by examiner

CONTAINER HAVING A TEARABLE PACKET THEREIN

This application claims priority from U.S. Provisional Patent Application 61/355,600, for a "CONTAINER HAVING A FRANGIBLE PACKET THEREIN," filed Jun. 17, 2010 by David DiLiberto et al., which is also hereby incorporated by reference in its entirety.

A collapsible, multi-compartment, container having a flexible outer pouch containing a tearable inner packet therein. More particularly, the inner packet is connected, possibly via a link to the outer pouch in a manner such that displacement of a surface of the outer pouch applies a stress to the inner packet and provides for a rupturing or tearing of the inner packet, and release of the material therein to be mixed with the material in the outer pouch.

BACKGROUND AND SUMMARY

Various devices and methods are known for the dispersion of one material into another at the time of use within a self-contained container (e.g., cold compress packs). Multi-part containers of this type are useful for the separate storage of ingredients or materials for a variety of products, where at least two ingredients can be stored separately for reasonably long periods of time, and when admixed will produce a desired mixture. The materials must generally be maintained separately until shortly before use to avoid a propensity to degrade in quality over a relatively short period of time.

Where such mixtures are consumables, they are generally stored and sold in an isolated format and the components of the mixture remain segregated during storage and then are mixed just before use. Mixture at the time of use is beneficial because the combined solution fails to retain its initially mixed qualities over time. Such products usually, but not necessarily, comprise at least one liquid ingredient and at least one additional ingredient which may be in the form of a liquid, dry granules or powder.

One such product is a protein-based beverage, where the protein-containing component is produced and stored separate from a liquid component and the two are mixed just prior to the time consumption. Given the desirability of mixing beverage components just prior to use the disclosed embodiment provides a package for separately storing components in a single package, where the components may be stored in an integrated compartment(s) or packet(s), one of which may be torn or otherwise ruptured to permit the components therein to mix before use. This is advantageous since it facilitates the shipment, storage and sale of such products as discrete ingredients, extending shelf life, as well as effectiveness by avoiding premature mixing. Moreover, having the components in separate compartments of a single flexible pouch permits the pouch to serve as both a mixing and dispensing container, thereby assuring admixture of the materials in the proper proportions while eliminating the potential of unintended mixing or spoilage. It is further contemplated that tearing of the inner packet, and intermixing of the two components, may be initiated by applying force(s) with the hands to different portions of the exterior of the container.

Multi-compartment containers or packs are known for use with instant hot/cold packets, preparation of amalgams in dentistry, reconstituting infusion medicine and chemiluminescent devices. Notably there are few, if any, offerings of multi-compartment packages within the food and beverage or consumable market, presumably due to the inability to economically construct and fill packaging that would satisfy the criteria for mixing components only at or just prior to the time of use. The apparent difficulty centers around the requirement to maintain an impervious separation of the components until a time when the consumer wishes to combine the components in a mixture. In order to overcome this limitation the disclosed embodiments provide a package that includes a tearable inner compartment or packet, thereby releasing the contents of the packet for mixture with the surrounding liquid contained within the pouch.

As described in U.S. Pat. No. 4,057,047 for a thermal pack, a rupturable heat seal may be arranged to allow an interior pouch to burst in response to a manual force squeezing the contents of the interior pouch. However this also has the potential of rupturing the outer pouch and thereby allowing the contents to leak out. Thus, the very nature of the squeezing-dependant rupture concept, when applied to a pouch that also has a peripheral heat seal that forms the container, must be controlled in order to have a tearable or rupturable inner pouch along with a burst resistant outer pouch.

Provided in accordance with the disclosed embodiments is a packet enclosed within a pouch, each constructed of a flexible wall such as a film (single and/or multi-layer), possibly having several panels joined along a perimeter to form a pouch-like container. When the contents of the container are to be consumed, the inner pouch is torn or ruptured, possibly along a weakened region or stress concentration region (collectively referred to as a stress riser), thereby permitting mixture between the materials in the packet and the surrounding outer pouch.

One of the multi-compartment liquid containers disclosed includes an outer pouch formed from a flexible, liquid-impervious material and having an expansion region (e.g., a pleated bottom on the pouch). An inner packet, including a stress riser and force (e.g., tension) transmission link or member, is enclosed within the outer pouch, where the packet contains a substance for mixing with a liquid in the pouch to form a freshly prepared solution. The force transmission link is attached to and between the packet, at a position adjacent to a stress riser, and an anchor point on the outer wall of the pouch. The application of a force at a position on or near the anchor point causes the transfer of a tensile force, via the aforementioned connection link, to the packet. Upon exceeding the tear strength of the inner packet, perhaps due to a stress riser, the inner packet ruptures to permit mixing of the material in the packet with a liquid in the surrounding flexible pouch. The force may be applied in a number of methods including: (i) a user holding the container at the top and pulling on the anchor point for the link (possibly a tab associated therewith), and (ii) an external squeezing force applied to the pouch to put the inner packet in tension. The thoroughly mixed liquid is then made available through a spout or similar fitment, a straw or by cutting a corner of the pouch to permit pouring.

It is further contemplated that the package include means to ascertain if the contents of the packet remains intact and has not been accidentally mixed in order to provide to the retailer and/or consumer a confirmation that the package is intact. This could prove to be critical when the shelf life of the solution is dramatically influenced by a premature combination of the materials. Indicia may be used to indicate an accidental packet rupture as explained in more detail below.

The disclosed embodiments provide a tearable packet that facilitates the immediate and thorough dispensing of a material in the packet into a liquid surrounding the packet.

The embodiments disclosed further provide a beverage pouch that internally stores and then mixes an additive, such as a flavoring agent, seasoning, alcohol, medication or some other beverage enhancing ingredient into an associated liquid.

Another object is to provide a beverage container in the form of a pouch having an internal packet therein which is designed to disperse a quantity of material such as an additive to a liquid in the pouch to produce a beverage by manual action of the user.

It is a further object of the disclosed embodiments to provide a means to extend the shelf life of materials that do not retain their stability, strength or effectiveness once they have been mixed into a solution.

Another object is to provide a region on the surface of the frangible packet that is predisposed to rupture to enable the concentration of stress and thereby failure of the packet in a specific area.

Lastly, an additional object is to provide an indicia to indicate if mixture has occurred prior to purchase or use using either a colorant or other or similar means.

Accordingly, it is an object of the disclosed embodiments to provide a pouch filled with a liquid and a frangible or rupturable internal packet, filled with a substance to be mixed with the liquid, whereby the application of an external force is conveyed from outside the pouch to the packet via a link, tab or similar member to rupture the inner packet.

Disclosed in the embodiments described below is a multi-compartment container, comprising: an outer flexible pouch formed from a flexible, liquid-impervious material; and an inner packet, substantially enclosed within said outer flexible pouch, wherein said inner packet contains a substance for mixing with a material contained within the outer flexible pouch; said inner packet being operatively connected to an anchor point on said outer flexible pouch, wherein a force applied to said anchor point causes the tearing of the inner packet and thereby permits mixing of the substance in the inner packet with the material in the outer flexible pouch without direct access to the inner packet.

Also disclosed in embodiments described below is a method of preparing a multi-compartment container, comprising: preparing an outer flexible pouch for the receipt of a first material therein; preparing an inner packet impervious to the first material in the outer pouch, said inner packet including a second material therein and said inner packet being located within said outer flexible pouch; providing a link between a surface of the inner packet and a surface of the outer pouch; and sealing the inner packet and the outer pouch and the respective materials therein to create a flexible, multi-compartment container.

Also disclosed herein is a method for use of a multi-compartment container, said container comprising an outer flexible pouch having a first material therein along with an inner packet having a second material stored within said packet, and a link between a surface of said inner packet and a surface of said outer pouch, said method including: applying a force to a surface of the outer pouch to create a tensile force along at least a portion of the surface of the inner packet, said tensile force of sufficient magnitude to cause the tearing of the surface of the inner packet and release of the second material to combine with the first material of the outer pouch.

Other and further objects, features and advantages of the disclosed containers and methods will be evident from a reading of the following specification and by reference to the accompanying drawings forming a part thereof, wherein the examples of the presently preferred embodiments are given for the purposes of disclosure.

BRIEF DESCRIPTION OF THE DRAWINGS

The disclosed embodiments will be more fully understood and further advantages will become apparent when reference is had to the following detailed description and the accompanying drawings, in which.

Figure 1:
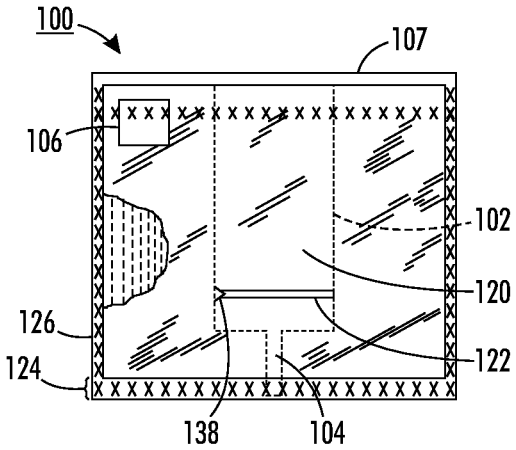
FIG. 1 illustrates a front view of a pouch having a packet therein.

The various embodiments described herein are not intended to limit the disclosure to those embodiments described. On the contrary, the intent is to cover all alternatives, modifications, and equivalents as may be included within the spirit and scope of the disclosure.

For a general understanding, reference is made to the drawings. In the drawings like references have been used throughout to designate identical or equivalent elements. It is also noted that the drawings may not have been drawn to scale and that certain regions may have been purposely drawn disproportionately so that the features and concepts could be properly illustrated.

DETAILED DESCRIPTION

As used herein the term "pouch" will be understood to reference a bag-like container. In the multi-compartment container, pouch-like structures may be employed for each of the various compartments. To facilitate the discussion, the term pouch has generally been employed to refer to an outer flexible container whereas the term packet is generally used to refer to an internal envelope like compartment holding an additive. It is also understood that a plurality of packets may be provided inside a single outer pouch although the depicted embodiments only include a single interior compartment. However, it is further understood that such terms are not to be considered mutually exclusive or limiting in that terms such as pouch, packet, container, carton, box, envelope and others are expressions that similarly describe the concept of a flexible compartment or container. As used herein the term "tearable" is used to describe a characteristic of the packet, as a structure or material that is capable of being pulled or separated into pieces, or to come apart or rip the packet.

Figure 2:
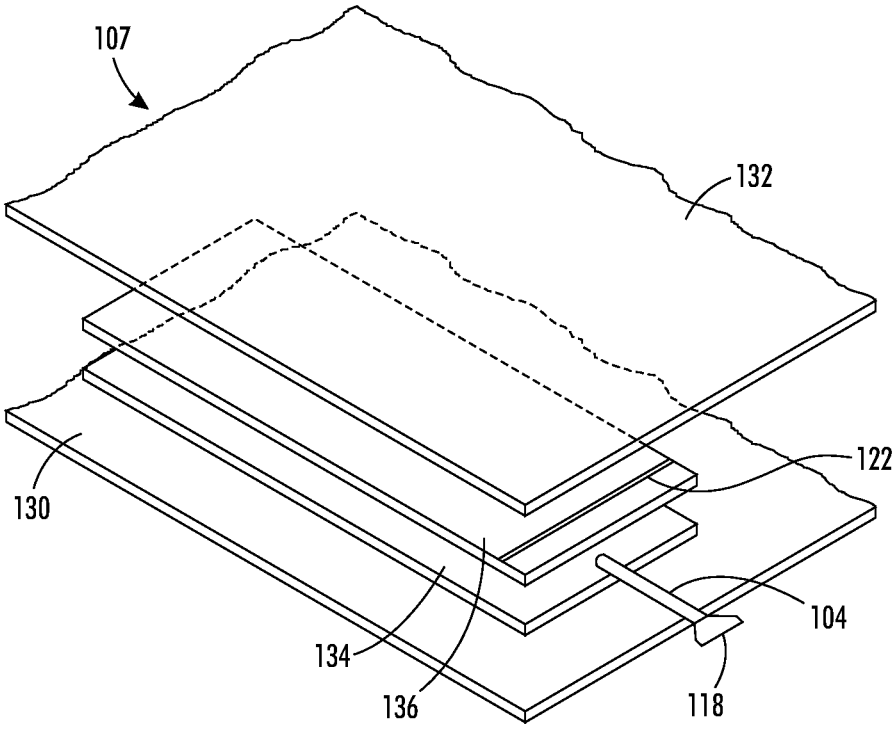
FIG. 2 is an isometric assembly view of the pouch in FIG. 1.

Referring to FIGS. 1 and 2, the figures illustrate a first embodiment wherein packet-in-a-pouch container 100 includes packet 102 being contained entirely within the boundaries of a pouch 126. Pouch 126 may be a gusseted or stand-up pouch design as well as other shapes and sizes. Packet 102 is attached along a common edge or seam at the proximal end 107 in order to facilitate filling of both the packet and pouch before sealing. At or near the distal end of packet 102 a tab or link 104 is attached to the packet for the purpose of pulling the packet as described below. It will be appreciated that while depicted as attached along one edge of the pouch 126, inner packet 102 may be attached in various orientations, including top-to-bottom, side-to-side, corner-to-corner or diagonally, etc. Inner packet 102 may also be a single-compartment packet as illustrated in FIG. 1, or it may be a divided packet, where two or more compartments are provided to enclose multiple materials, both of which would be mixed when the packet is torn. Also contemplated is an embodiment that includes multiple inner packets 102, wherein the packets are similarly torn or opened by the various operations described below.

Pouch 126 may be constructed from a flexible, thin-film plastic or similar layer(s) of material that is impervious to the outside atmosphere such as known materials used for stand-up pouches, and including films, flexible webs and laminates with either or both sides transparent or foiled with a metallic finish. Pouch 126 can be used for all kind of food packaging including liquids (e.g., beverages) and liquid-like products (e.g., sauces, yogurt, etc.). Specific examples of materials that may be employed to form the outer pouch and/or inner packet are polyethylene terephthalate (PET), polyester films such as Mylar®. PET can be aluminized for heat reflection by evaporating a thin film of metal onto it which also reduces its permeability to liquid and light. PET is further suited for flexible food packaging, such as carbonated water, fruit juice or other sterile liquids. Similarly, one or more components of the container may use polylactic acid (Polylactide) a biodegradable polymer produced by NatureWorks LLC.

It may also be desirable to provide the end user an indicia to determine if a tear or rupture in the packet has occurred. In one embodiment, an innocuous color dye may be added to the material contained within packet 102, so that when mixed with the liquid contents of pouch 126, a distinctive color is apparent when viewed through a clear portion or window 106 of the wall(s) of pouch 126. Additionally when mixing has been intentionally initiated, the colorant will confirm that the contents of packet 102 have been mixed with the fluid of pouch 126. An alternative would be to rely on the mechanical operation of the packet-in-a-pouch 100, whereby the indicia could include a mechanical seal operatively associated with the inner packet or flexible link, where tearing the inner packet reveals a message or advisement 123 that was previously occluded within the fold of pleat 124 prior to pulling on tab 118 to tear the packet (see e.g., FIG. 4B). Other mechanical seals or indications may well be on the pouch, such as a tear strip or a safety seal along pleat 124 and/or associated with tab 118. It should be understood, however, that link 104 in combination with packet 102 prevents pleat 124, as well as the bottom portion, from extending, unless a rupture in the wall of packet 102 has occurred.

Packet 102 is made from a flexible material; however it is not limited to a flexible film, as other materials may prove to be practical in specific applications. For example, packet 102 could be assembled by molding polystyrene into pre-filled capsules that would then be inserted and attached within pouch 126. Packet 102 generally contains a liquid, granular or pulverulent material such as vitamins, protein, flavoring, sweeteners, or any other enhancing ingredients that, due to hydrolysis or similar decomposition, potentially shorten the shelf life of the admixture.

Packet 102 further includes specific structural elements to enable the controlled release and dispersion of the ingredient (s) or material contained in packet 102 into the liquid in pouch 126. As seen in FIG. 2 the proximal edge of packet 102 is restrained and anchored along with a peripheral edge of pouch 126 (both edges 107), while tab 104 on the distal edge links to an opposing side of pouch 126. Now it can be appreciated that by sealing the bottom and both sides of wall panels 136 to 134 and 132 to 130 the assembly can be reliably filled through the remaining open region along the upper most coinciding edge (top 107) of packet 102 and pouch 126. The resulting assembly, complete with the substances therein, may then be subsequently sealed along the top edge 107 via heat, chemical or possibly a mechanical closure method.

Notably, area 122 denotes a region that has been predisposed and designed as a stress riser section where any stress in panels 134 and 136 is substantially concentrated and focused at area 122. In other words, area 122 provides a weakened portion of the packet wall by reducing the cross-sectional thickness, resulting in a localization of applied stress that ultimately tears or ruptures panel 134/136 along or near area 122. It will also be appreciated that other means for creating a stress riser are conceivable, for example a score caused by a laser or a creasing tool, as well as a sharp angle or bend in the wall panel of the packet that will further concentrate a force. The aforementioned stress riser at area 122 is equally applicable on back panel 134 as well and could yield in cooperation with panel 136, however severing just a single panel would yield similar results—permitting the material inside the packet 102 to mix with the liquid in the pouch 126. It is also contemplated that the stress riser could be or include a sharp indentation 138 along the sealed edge of panels 134 and 136.

It will be appreciated that in order to assure that the inner packet 102 is torn or ruptured without impacting the ability of the outer pouch 126 to retain both the packet and pouch materials therein for mixing, the tearing force required for tearing the inner packet must be less than the force required to tear or otherwise cause a rupture of the outer pouch. As noted above, this can be achieved through the use of a stress riser on the inner packet. It is also contemplated that such a feature can be accomplished through the use of a material or film for the inner packet wall(s) or panel(s) 134 and/or 136 that is inherently weaker than the outer pouch material or is otherwise weakened in some manner (e.g., scoring).

Figure 3:
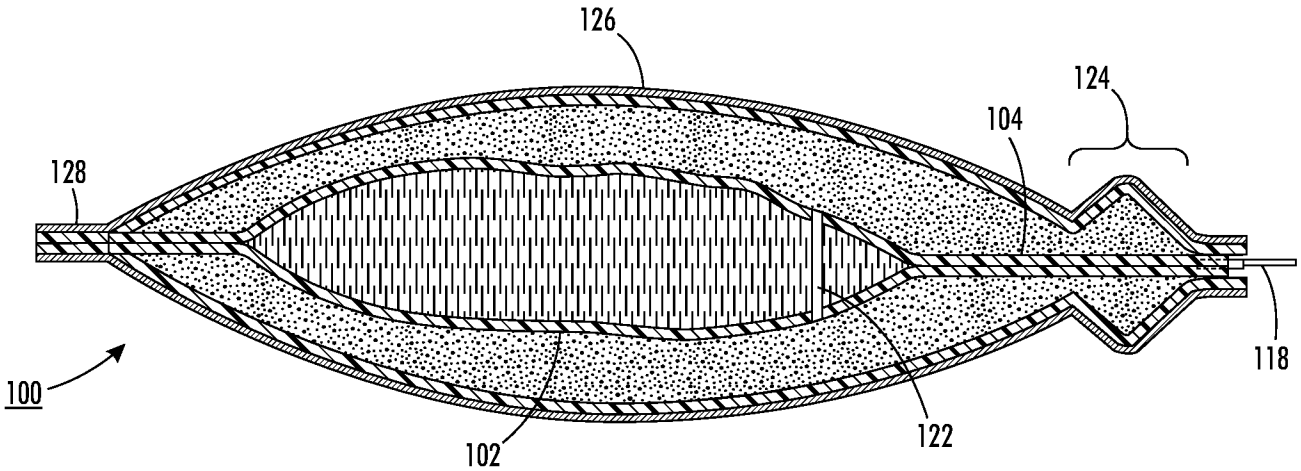
FIG. 3 is a cross-sectional view of a filled pouch and packet.
Figure 4A:
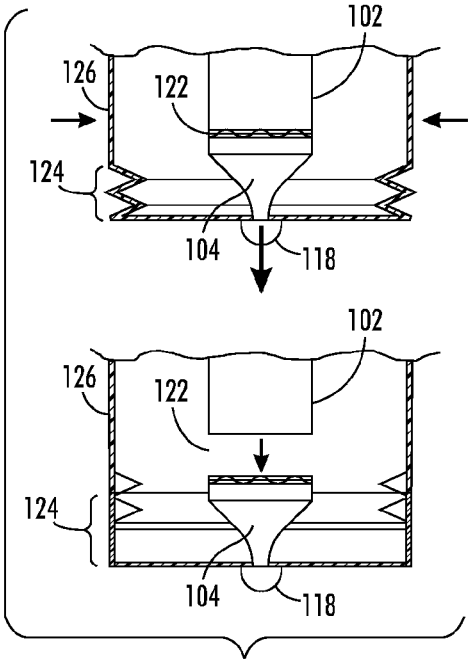
FIG. 4A is a front cross-sectional view of the pouch including an expansion pleat at the distal end.
Figure 4B:
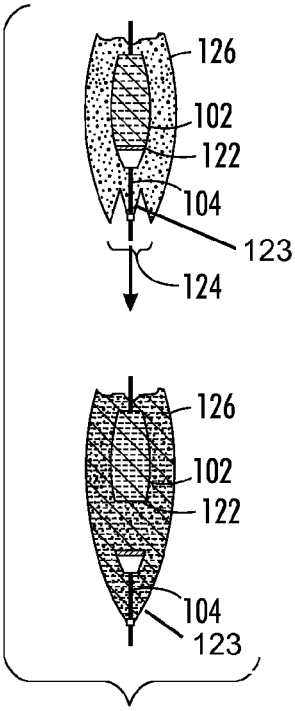
FIG. 4B is a cross-sectional view of the pouch showing an alternative pleat arrangement.

Turning now to FIG. 3, shown therein is a longitudinal cross-section of the container 100 whereby the liquid contained within pouch 126 is isolated from the contents of packet 102 until ready for use. Referring also to FIGS. 4A and 4B, each shows respective expandable outer pouches 126, wherein a pleated or gusseted bottom section 124 is employed to permit expansion or extension of the pouch bottom. In both embodiments, when the bottom section 124 is moved relative to the opposite end of the pouch, and in particular the bottom end of packet 102, stress is applied along region 122 and results in the tearing or separation of the packet at or near area 122.

Figure 5:
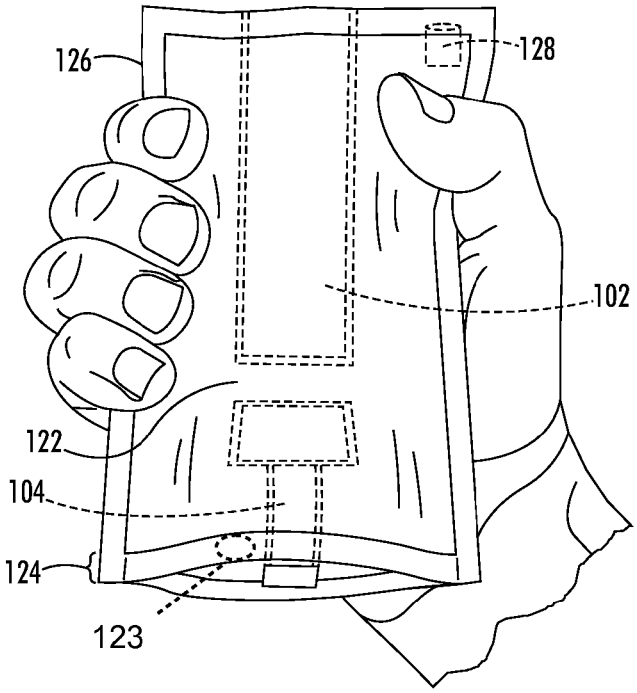
FIG. 5 illustrates and example of the manual manipulation of the pouch.
Figure 6:
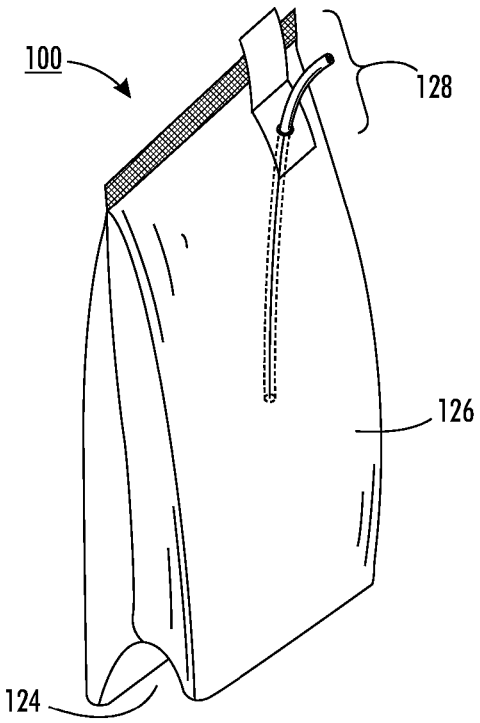
FIG. 6 is an isometric view of the pouch shown with a straw for access to the beverage.

Flexure or pleated section 124 may be formed from a bi-fold or accordion fold at the distal end of pouch 126 (panels 130/132) to provide a pleat 124 that permits a dimensional increase when a force is applied to the outer pouch, for example, to tab 118 by pulling thereon and/or by an external squeezing pressure applied manually by the user's hands to pouch 126 as depicted in FIG. 5. Accordingly, when container 100 is ready for use, a force is applied, which results in the displacement of a wall or edge of the outer pouch away from the interior packet such that link 104 pulls on the packet wall or other packet feature in a manner sufficient to rupture or tear packet 102 and release the material therein (FIG. 4B top portion, where cross-hatching shows material in packet 102). If the pocket includes a stress riser, the tear or rupture may occur along area 122 as seen in FIG. 4A. In other words, as pleat 124 unfolds or expands to dimensionally compensate for the applied force (pulling on tab or squeezing of outer bag) and to allow for the internal displacement of the link and tearing of packet 102. Upon the rupturing of packet 102, intermixing of the liquid outside the packet and the material inside the packet occurs (represented by cross-hatching of entire pouch contents in lower portion of FIG. 4B), and may be aided by shaking or applying pressure with the hands to various portions of the exterior of pouch 126 to force the agitate liquid or cause it to flow in a turbulent manner, as shown in FIG. 5. The mixture is now ready for use and may be withdrawn through re-sealable fitment or a straw 128, as depicted in FIG. 6, located near the proximal end of pouch 126.

As will be apparent the application of pressure with the hands can cause the mixed solution to be forcibly expelled, in the case of viscous mixtures such as yogurt with added foodstuffs (e.g., fruit, granola, etc.). And, in the case of a beverage, the mixture may be drawn through straw 128. Pleat 124, as viewed in FIG. 4B, can be constructed as an inward fold along the bottom of pouch 126, which unfolds as tab 118 is drawn outwardly as further illustrated in FIGS. 5 and 6.

Figure 7:
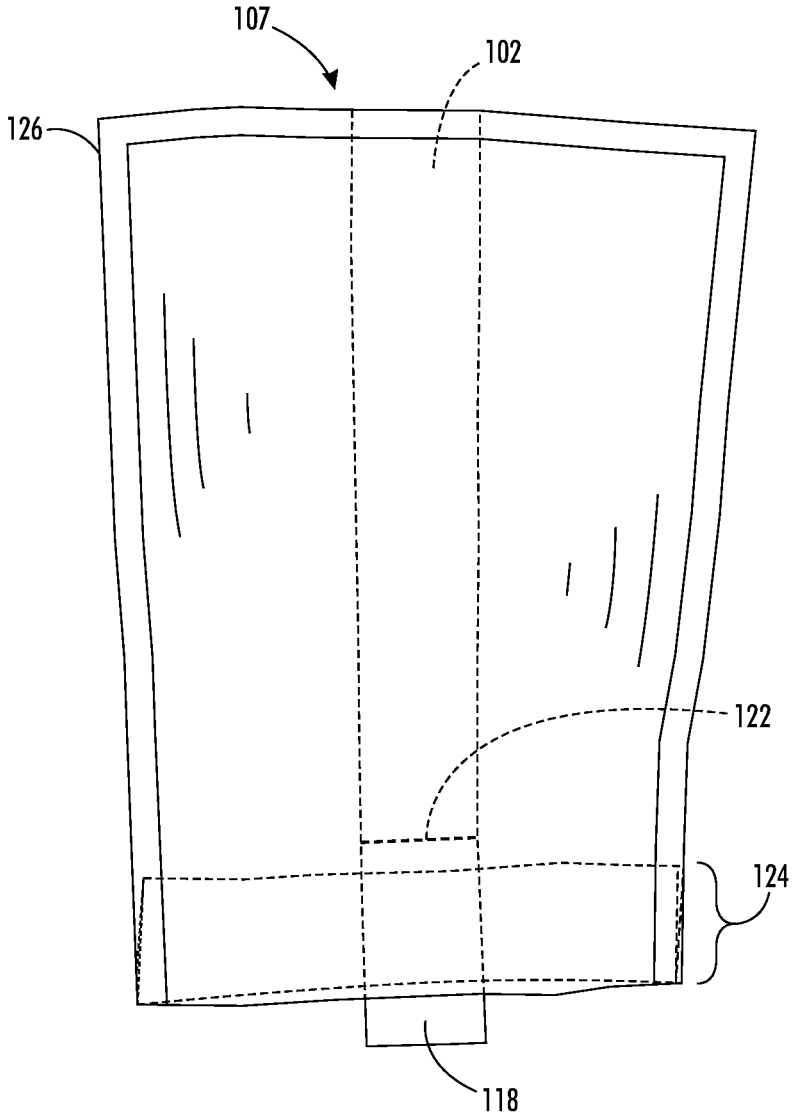
FIG. 7 is a front view of an alternative pouch embodiment with a full-length packet therein.

Referring to FIG. 7, depicted therein is an alternative embodiment of the pouch 126. As described above, the pouch may be constructed from a flexible, thin-film plastic or similar layer(s) which may be translucent. Inside of the pouch 126, is a packet 102 extending the entire length of the pouch, and out the bottom thereof to form a tab 118. The packet and pouch may be constructed from the same length of material, and the folding of the lower portion of the pouch (to provide for expansion and a self-standing pouch) but not the packet material, provides excess packet material that extends beyond the pouch to form the tab. The pouch and packet are sealed along both sides and the bottom, but remain opened at the top, along edge 107, for receiving materials into the pouch 126 and packet 102. Once filled, of course, the edges of both the pouch and packet would be sealed. As described above, application of a tensile force to area 122 of the packet results in a tearing of the packet and allows the contents of the packet to be mixed with those of the pouch 126. With the transparent or translucent nature of the pouch, or a portion thereof, the mixture may be confirmed.

In summary, multi-compartment container 100 comprises an outer flexible pouch 126 having a first material therein along with an inner packet 102 having a second material stored within said packet, and a link (e.g., flexible link, extended portion of the inner packet, etc.) between a surface of said inner packet (134, 136) and a surface of said outer pouch (130, 132). One method of using the multi-compartment container 100, includes applying a force to a surface of the outer pouch, where the link or packet is attached, to create a tensile force along at least a portion of the surface (130, 132) of the inner packet, the tensile force, of course, being of sufficient magnitude to cause the tearing of the inner packet surface and thereby resulting in the release of the second material to combine with the first material of the outer pouch.

Turning next to FIGS. 8A-8D, depicted therein is an illustration of various operations associated with the preparation of a pre-made packet as may be employed in the embodiments described above. Producing gusseted stand-up pouches with an internal, tearable packet designed for mixing with the main pouch contents requires three main components. First, the internal packet is formed in six steps (see reference numerals 810, 820, 830, 840, 850 and 860). It should be noted that the packet material must be thermally symmetrical, or a mono-layer material, as both sides of the material must be able to seal to each other as well as the sealant layer of the gusset and main pouch body. This material is unwound and processed through a dancer so that it can be intermittently indexed to the desired length of the packet.

Figure 8A:
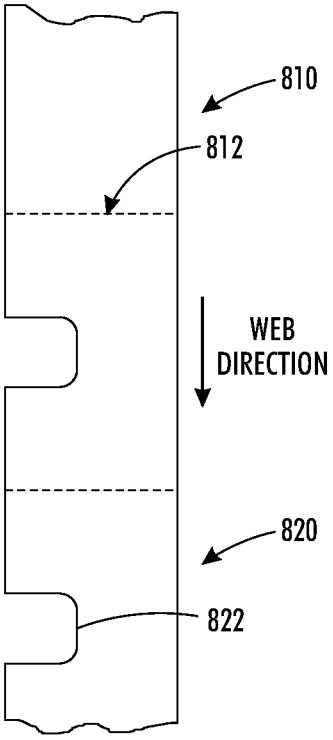
FIGS. 8A-8D are illustrative examples of operations in accordance with one pouch manufacturing method.
Figure 8C:
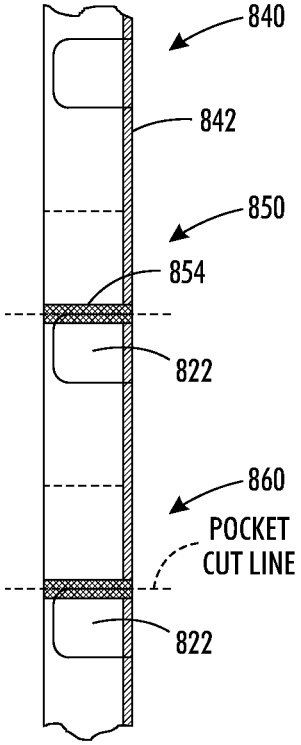
Figure 8B:
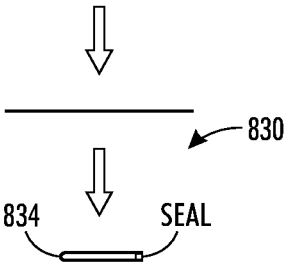
Figure 8D:
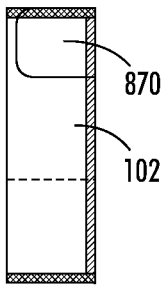

The first intermittent process 810 scores the material along score line 812. This score line will be split or torn by the end user at the time of mixing. Next, at operation 820, the flat web is punched in order to produce an opening 822 through which the packet contents can be filled. For operation 830 (FIG. 8B), the packet web is folded along 834 back on itself in preparation for edge sealing. At 840 (FIG. 8C), the unfolded edge 842 of the folded packet is sealed to create a continuous "tube" with openings at regular intervals for filling. Next, the packets are created at operation 850 in the tube by end sealing at 854 across one edge of the punched opening (822). Finally, at operation 860 the finished packets are cut along edge seal 854 (cut line 862) from the tube of material, to produce a finished packet as depicted in FIG. 8D, where the packet 102 includes an opening 870 for filing.

While the pocket is being formed, the specialized gusset with built-in tab is created in four main steps as represented by the drawings of FIGS. 9A-9E. Referring to those drawings, it is not required that the gusset material be thermally symmetrical or mono-layer like the packet. If the gusset material is a typical lamination with the thermally supportive layer on the outside of the material, the gusset must be punched to create an area where the front and back panels of the gusset can be tacked together. This allows the finished product to stand up.

Figure 9A:
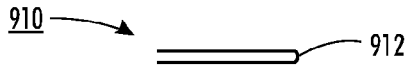
FIGS. 9A-9E are further illustrative examples in accordance with a gusset and pouch manufacturing method.
Figure 9B:
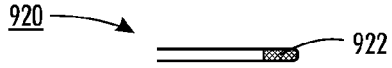
Figure 9C:
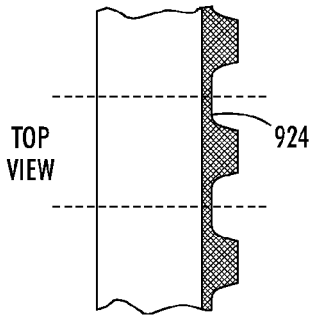
Figure 9D:
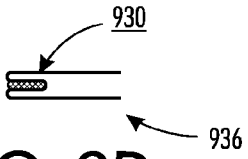
Figure 9E:
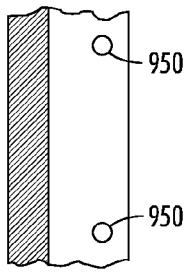

Beginning with operation 910 in FIG. 9A, the gusset material is unwound and processed through a dancer so that it can be intermittently indexed to the width of the finished pouch. The first step (910) in pouch forming is folding the gusset material in half at 912. Second, at FIG. 9B (operation 920) the folded end of the material is sealed along 922 to create the gusset pull tab. At this point the sealed tab can be punched in order to create a pull tab that is not full pouch width (e.g., FIG. 9C, punched region 924). The next step, 930, is to fold the material back onto itself in preparation for insertion into the main pouch. If the gusset material is not thermally symmetrical or mono-layer, it is possible to add gusset tack punches 950 at this point.

Figure 10:
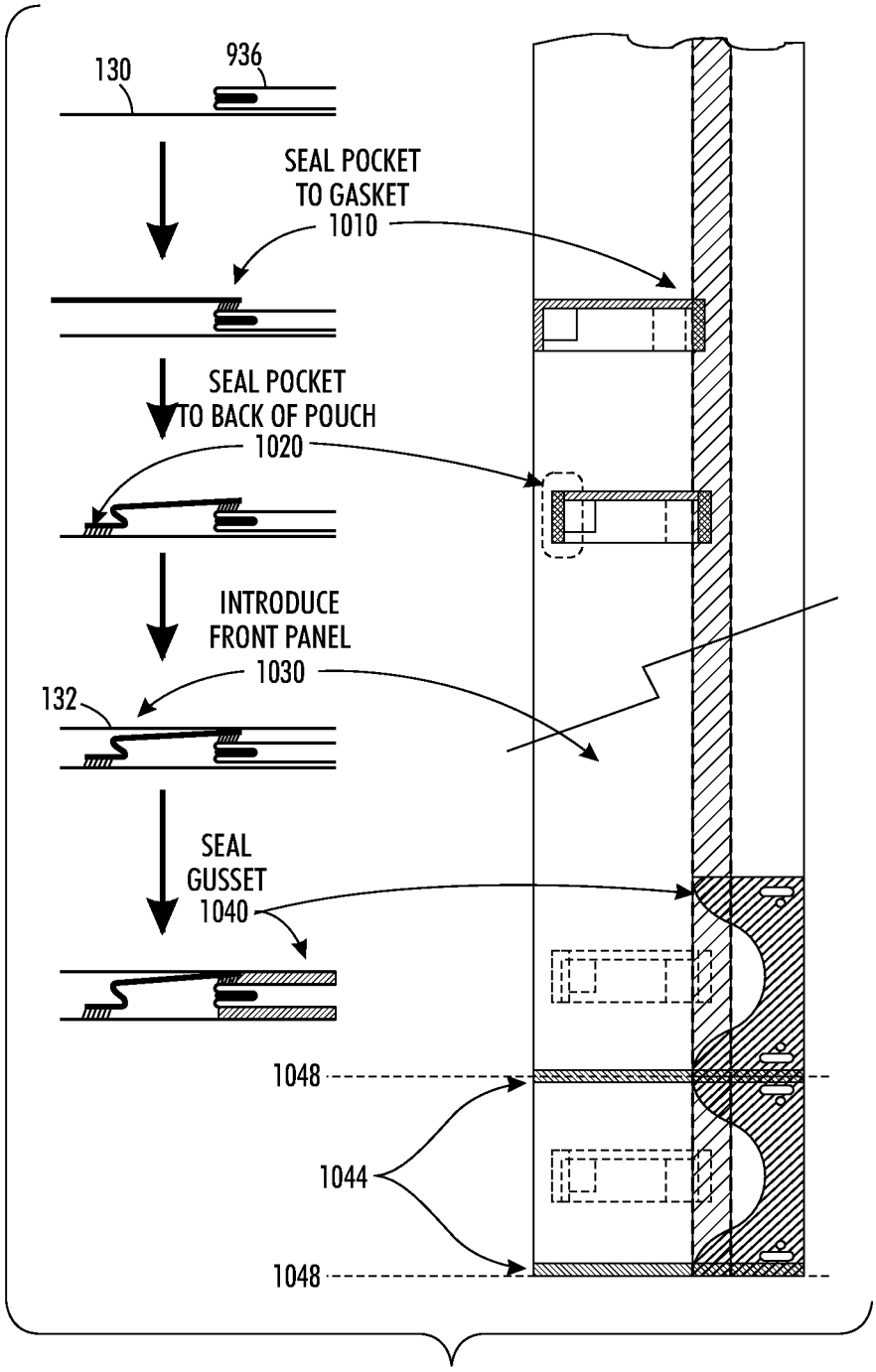
FIG. 10 is a representation of the combination of the manufactured components.

Finally, as represented by the various operations of FIG. 10, the packet and gusset must be inserted and attached to the main pouch in four steps. First, at 1010, the end of the packet opposite the opening (1014) is sealed to the tip of the gusset. Second, the opening end of the packet is sealed to the back panel of the main pouch (optionally it is later sealed with the top of the main pouch along edge 107 as described above). It is important to note that the opening end of the pocket should be sealed below the area where the final main pouch top seal will be made, and there must be some accumulated pocket material between the point where it is sealed to the gusset, and the point where it is sealed to the back panel. This accumulated pocket material will allow the main pouch to be filled without fracturing the packet score line. As seen at 1030, the front panel of the main pouch 132 is introduced over the sealed packet. At 1040, the gusset area is sealed to both front and back panels of the pouch. At this point, the side or cross seals 1044 can be added and the pouches cut-off along lines 1048 at the end of the machine.

Figure 11A:
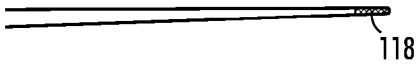
FIGS. 11A-D are illustrative examples of the disclosed pouch in a forming-filing-sealing manufacturing method in accordance with an embodiment.
Figure 11B:
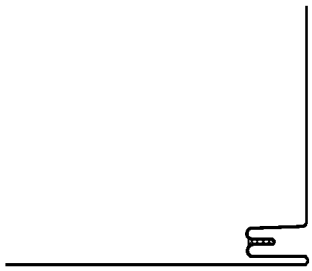
Figure 11C:
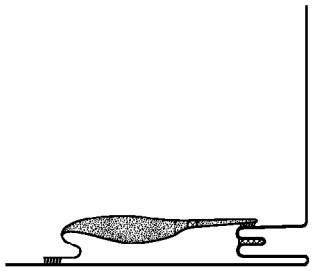
Figure 11D:
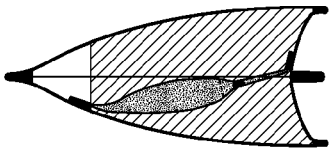

In the manufacturing/assembly operation depicted in FIGS. 11A-11D, there are illustrated alternative operations to accomplish the insertion of a packet within an outer, gusseted-bottom pouch. IN the first step depicted in FIG. 11A, the pull tab region of the gusseted pouch is created by sealing along at least a portion of a fold in the pouch material. Next, at FIG. 11B, the gusseted region of the pouch is formed by folding the tab end of the pouch, keeping the pouch front opened (vertical), so that the packet formed in FIGS. 8A-E can be inserted as depicted in FIG. 11C. The packet 102 is placed on the folded gusset and sealed in the region of the tab 118, thereby assuring that pulling on the tab portion of the gusseted bottom will apply a tensile force to the packet. Next, as represented by FIG. 11D, the front side of the pouch is folded over and the sides are sealed to form the pouch. Although depicted with a filled inner pouch being attached in FIG. 11C, also contemplated is filling and sealing of the pouch and packet in a generally concurrent process. In such an operation it may be that the top edges of the pouch and packet are concurrently sealed by a common sealing operation that results in them being sealed and along the same line.

Figure 12:
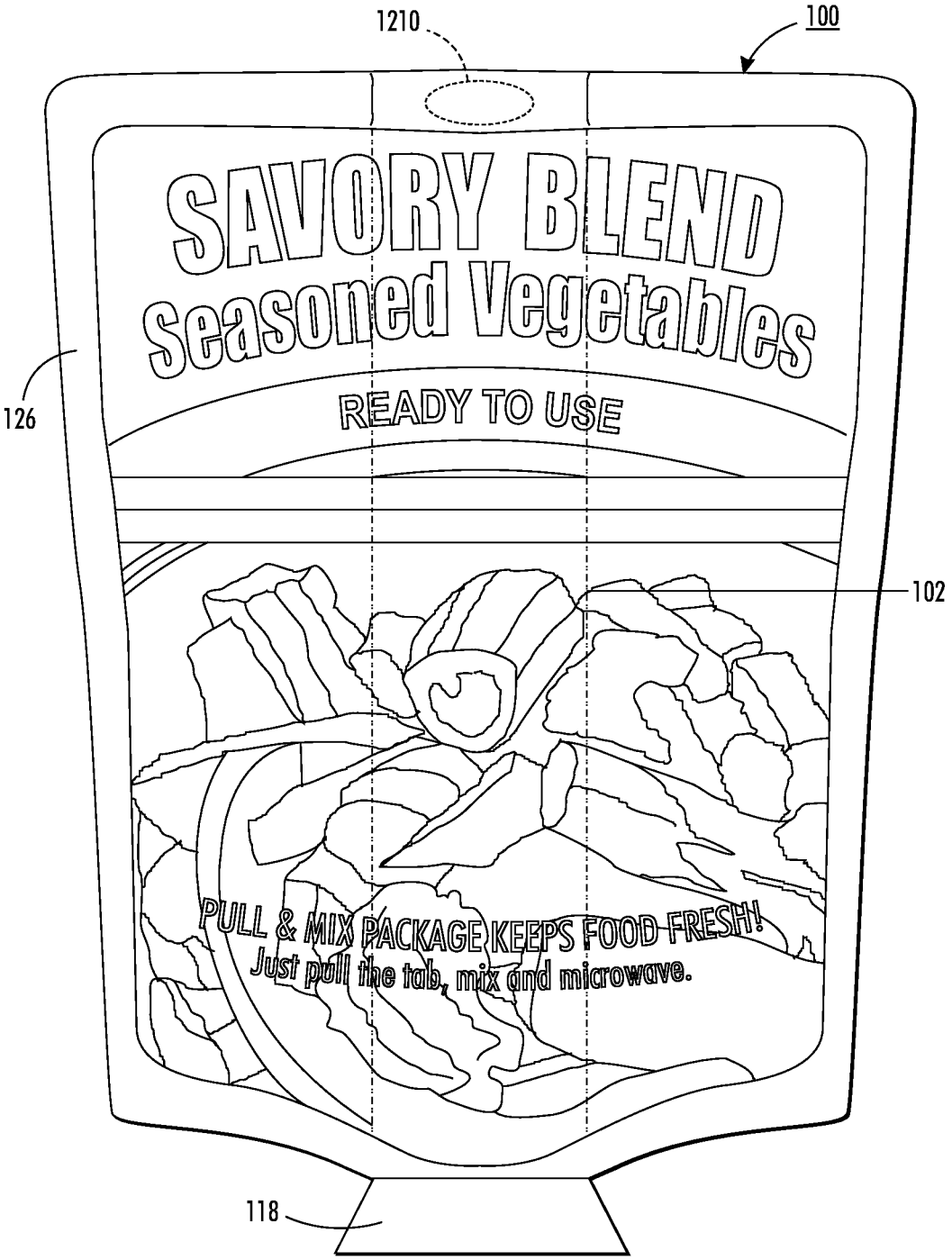
FIGS. 12 and 13 are illustrative examples of the pouches with respective food or beverages therein.
Figure 13:
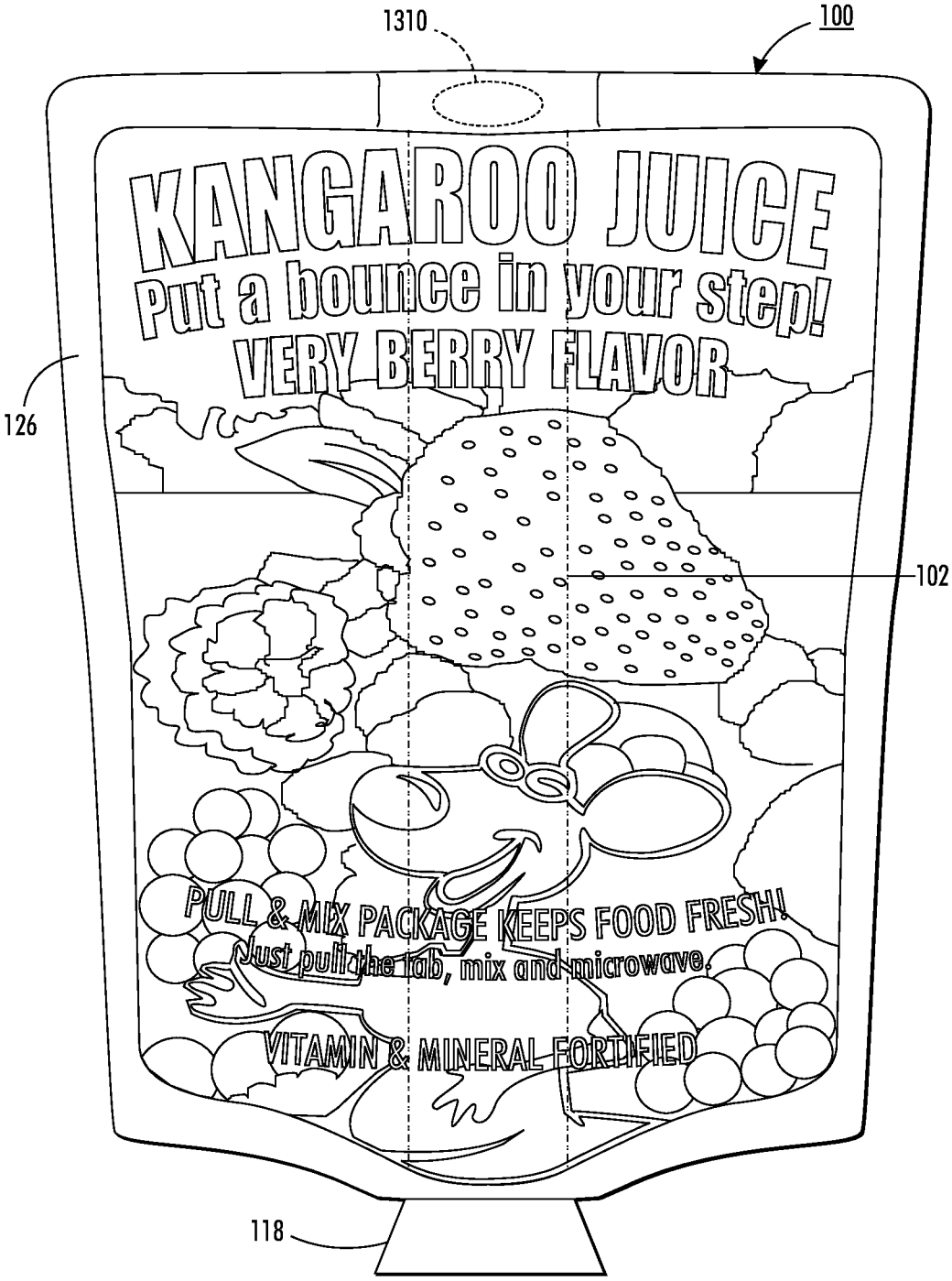

Turning to FIGS. 12 and 13, depicted therein are embodiments of the multi-compartment container or package 100, each having a different application and consumable product therein. In the case of FIG. 12, the outer pouch 126 includes vegetables or other ready-to cook/heat foodstuffs, and the inner packet includes a seasoning mix, margarine, dressing, etc. that is preferably applied to the foodstuffs, immediately before or after cooking/heating. As described above, one way of using the container is a user pulling on the top of the outer pouch at position 1210 and at tab 118; which will cause the tearing of the inner packet 102, thereby releasing the seasoning or other material to be applied to the foodstuff in pouch 126.

Referring to FIG. 13, outer pouch 126 includes a beverage or other liquid, and the inner packet includes an additive, flavoring, etc. that is preferably mixed with the liquid in the outer pouch immediately prior to consumption. As described previously, container 100 may be used by squeezing the pouch, or pulling on the top of the outer pouch at position 1310 and at tab 118, to cause at least a portion of the inner packet 102 to be placed under tension and torn, thereby releasing the material contained in the packet to be mixed with the liquid material in pouch 126 before being consumed or used.

The materials that may be packaged within, for example, the outer pouch 126 and inner packet 102, include various materials, and in several exemplary embodiments foods or beverages specifically. As indicated above, however, the possible uses of the disclosed embodiments are not limited to a package for food or beverages, and may be applied to any of a number of other materials that should be maintained in separate packaging compartments until the time of use. In other words, a multi-compartment container in accordance with the features disclosed herein may be used for the separate storage of ingredients or materials for a variety of products, where at least two ingredients can be stored separately for long periods of time, and when the inner packet(s) is torn, the materials are combined to produce a desired mixture. The materials must generally be maintained in separation until shortly before use to avoid a propensity to degrade in quality over a relatively short period of time.

While the various embodiments have been described with respect to a pouch which is essentially rectangular in shape, it is to be understood that it is applicable to pouches of other shapes and sizes, such as a triangular or trapezoidal perimeter possibly having curved corners.

It will be appreciated that several of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. A multi-compartment container, comprising:

a burst resistant outer flexible pouch formed from a flexible, liquid-impervious material, wherein said outer flexible pouch further includes an expansion pleat at a bottom end to provide a stand-up pouch, said expansion pleat including multiple folds on each side of a downward extending sealed edge;

an inner packet, substantially enclosed within said outer flexible pouch, and sharing at least a portion of a common top edge with said outer flexible pouch, said common top edge providing a common opening for filling of said outer flexible pouch and inner packet prior to sealing both the outer flexible pouch and inner packet along said common top edge, wherein said inner packet contains at least one substance for mixing with a material contained within the outer flexible pouch;

said inner packet being operatively linked to an anchor point on the downward extending sealed edge of the expansion pleat of said outer flexible pouch, wherein a force applied to said anchor point causes the tearing of the inner packet and mixing of the at least one substance in the inner packet with the material in the outer flexible pouch without direct access to the inner packet.

2. The container according to claim 1, wherein said inner packet includes a stress riser to encourage tearing of the inner packet in response to the applied force.

3. The container according to claim 2, wherein said stress riser includes a reduction in the cross-sectional thickness of a wall of the inner packet in a defined area on the inner packet.

4. The container according to claim 2, where the stress riser is a scored region along at least a portion of the inner packet.

5. The container according to claim 1, wherein the inner packet is connected to the anchor point via a flexible link.

6. The container according to claim 1, wherein said outer flexible pouch contains a fluid, and said inner packet contains a material that is soluble within the fluid to form a mixture, where the material contained in said inner packet is selected from the group consisting of dry granules and powder.

7. The container according to claim 6, further including a fitment, said fitment being associated with an opening in said outer flexible pouch provided for evacuating the mixture.

8. The container according to claim 1, further including indicia that the inner packet has been torn.

9. The container according to claim 8, wherein said indicia is a colorant contained within the inner packet and viewed through said outer flexible pouch upon tearing of the inner packet.

10. The container according to claim 8, wherein the indicia includes a message occluded within one of the folds of the expansion pleat and where the message is revealed upon the tearing of the inner packet.

11. A gusseted container, comprising:

an outer flexible pouch formed from a flexible, liquid-impervious material, wherein said outer flexible pouch further includes an expansion pleat at a bottom end to provide a stand-up pouch, said expansion pleat including multiple folds on each side of a downward extending sealed edge;

an inner packet, substantially enclosed within said outer flexible pouch, wherein said inner packet contains at least one substance for mixing with a material contained within the outer flexible pouch;

said inner packet being operatively linked to an anchor point on the downward extending sealed edge of the expansion pleat of said outer flexible pouch, wherein a force applied to said anchor point causes movement of the folds and tearing of the inner packet and thereby permits mixing of the at least one substance in the inner packet with the material in the outer flexible pouch without direct access to the inner packet.

12. The container according to claim 11, wherein said expansion pleat further provides a base.

* * * * *